United States Patent [19]

Junak

[11] 4,188,182

[45] Feb. 12, 1980

[54] METHOD AND APPARATUS FOR IGNITING AND REIGNITING COMBUSTIBLE FUEL

[75] Inventor: Edward M. Junak, Grand Junction, Colo.

[73] Assignee: Teletronics Co., Inc. of Clifton, Clifton, Colo.

[21] Appl. No.: 828,195

[22] Filed: Aug. 26, 1977

[51] Int. Cl.[2] ..... F23H 5/02

[52] U.S. Cl. ..... 431/80; 431/25; 431/70; 431/74

[58] Field of Search ..... 431/70, 74, 78, 80, 431/25; 307/127, 117

[56] References Cited

U.S. PATENT DOCUMENTS

| | | | |
|---|---|---|---|
| 3,529,910 | 9/1970 | Potts et al. | 431/70 |
| 3,614,280 | 10/1971 | Tamio | 431/78 X |
| 3,975,136 | 8/1976 | Baysinger et al. | 431/74 |
| 3,986,814 | 10/1976 | De Mere | 431/80 X |
| 4,015,928 | 4/1977 | Carlson | 431/74 |

*Primary Examiner*—Edward G. Favors
*Attorney, Agent, or Firm*—Edwin L. Spangler, Jr.

[57] ABSTRACT

Apparatus for igniting and reigniting combustible fuel emitted from a burner structure by the method of sensing ion current flow across an electrically-conductive spark gap defined in the region in which the fuel is emitted and then generating ignition sparks thereacross whenever the ion current flow indicates the emitted fuel is not burning. The ignition sparks are generated by increasing the current in the primary winding of an ignition coil at a selected rate to a predetermined optimum level and then stopping the current supplied so as to cause the collapse of the electrical field thus generated in the inductive coil. The apparatus is battery powered, has low current drain as well as minimal power requirements, uses the same electrically-conductive probe for sensing the ion current flow and for spark delivery, has an indicator lamp driven by the current surges generating the ignition sparks which visually verifies the systems integrity, has circuitry which compensates for low battery voltage, and includes a filter capacitor which is selectively connected across the battery during ignition spark generation to enhance battery life and which is selectively disconnected from the battery when ignition sparks are not being generated, thus eliminating leakage currents.

17 Claims, 1 Drawing Figure

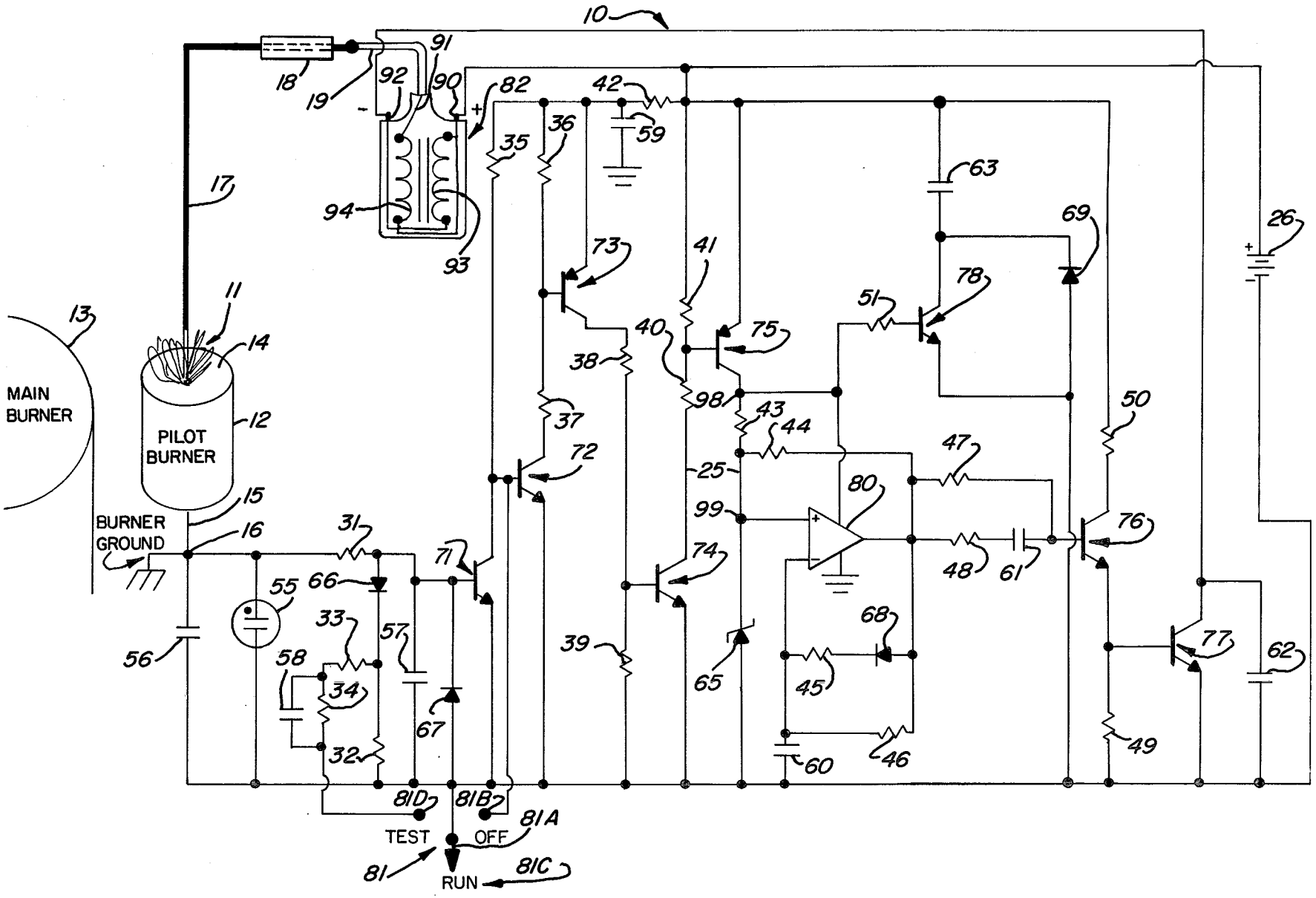
PILOT BURNER
MAIN BURNER
BURNER GROUND
TEST
OFF
RUN

METHOD AND APPARATUS FOR IGNITING AND REIGNITING COMBUSTIBLE FUEL

The present invention relates to the burning of combustible fuel mixtures, such as methane gas, and the ignition and reignition of same. More particularly, the present invention relates to an improved electrical ignition apparatus and method suitable for igniting and reigniting gas pilot lights.

The prior art electrically-powered ignitors for lighting and relighting gas pilot lights have, for the most part, been inefficient while consuming excessive electrical power and fuel in their standby modes as well as wasting power when delivering ignition sparks. Also, some of these prior art devices have had the disadvantage of requiring the use of separate probes or electrodes for sensing whether the pilot light is burning and for lighting same. The use of separate sensing and spark delivery probes, in addition to increasing the complexity of the ignitor circuitry, has the drawback of making installations of such ignitors in cramped burner spaces difficult and in some cases impossible. Furthermore, it is a good idea to be able to conveniently test the operation of such ignitor circuits in a reliable and dependable manner; however, typically this has not been possible to do with the prior art electrical ignitors.

It is, accordingly, an object of the present invention to provide an improved electrical ignition apparatus and method for starting and maintaining the burning of combustible fuel mixtures suitable for use in igniting and reigniting gas pilot lights which obviates the aforementioned disadvantages of the prior art.

It is also an object of the present invention to provide an improved ignition apparatus and method operable to selectively generate sparks to ignite and reignite combustible fuel mixtures and which possesses a highly efficient energy conversion capability.

It is additionally an object of the present invention to provide an improved ignition apparatus characterized by being battery powered and having a low standby mode current drain, yet which remains capable of reliably sensing pilot light and burner flame-out.

It is another object of the present invention to provide an improved ignition apparatus which includes provision for compensating itself against variations in the voltage level of the battery source powering it.

It is yet another object of the present invention to provide an improved ignition apparatus capable of reliably testing its own operation.

It is still another object of the present invention to provide an improved ignition apparatus wherein the same probe is employed to both sense a flame-out of the combustible mixture as well as to deliver sparks thereto for reigniting same.

It is further an object of the present invention to provide an improved ignition apparatus of the inductive discharge type characterized by being of simple and reliable construction and efficient and dependable operation.

In accomplishing these and other objects, there is provided apparatus for ignition and reigniting combustible fuel emitted from burner structure by the method of sensing ion current flow across an electrically-conductive spark gap defined in the region the fuel is emitted and generating ignition sparks thereacross whenever the ion current flow indicates the emitted fuel is not burning. The ignition sparks are generated by increasing the current in the primary winding of an ignition coil at a selected rate up to a predetermined optimum level and then stopping the current thus supplied thereby causing the collapse of the inductive field generated in the inductive coil. The apparatus is battery powered, has low current draw as well as power requirements, uses the same electrically-conductive probe for sensing ion current flow and for spark delivery, has an indicator lamp driven by the current surges generating the ignition sparks which visually verifies system integrity, has circuitry which compensates for low battery voltage, and includes a filter capacitor which is selectively connected across the battery during ignition spark generation to enhance battery life and which is selectively disconnected from the battery when ignition sparks are not being generated, thus eliminating leakage currents.

Additional objects of the present invention reside in the specific construction of the embodiment of the ignition circuit hereinafter described in conjunction with the single FIGURE drawing, as well as in its method of operation.

The single FIGURE is a schematic diagram of an ignition apparatus constructed according to the present invention illustrating it connected to ignite and reignite a gas pilot burner.

Referring next to the single drawing FIGURE for a detailed description, there is shown an ignition apparatus according to the present invention generally identified by the numeral 10 which is connected to initially ignite as well as reignite upon flame-out the gas 11 emitted from gas pilot burner 12. The pilot burner 12 is associated with and functions as the pilot light for main burner assembly 13.

The pilot burner 12 emits the combustible fuel or gas 11 from its tip 14 and is made of an electrically-conductive material. The pilot burner 12 itself is connected to ground by lead 15, the lead 15 being connected to terminal point 16 and the terminal point 16 being grounded. Positioned adjacent the pilot burner tip 14 in the region in which the gas 11 is emitted is one end of a conventional metal electrode or probe 17. The probe 17 is mounted in a ceramic insulator 18 and has its other end connected to a high voltage and sensing lead 19.

Circuitry 25 for sensing whether the pilot burner 12 is lit or has flamed-out and for delivering ignition sparks across the burner tip 14 to ignite gas or other combustible fuel 11 being emitted therefrom is connected between the circuit point 16 and lead 19. This circuitry 25 is powered by a single battery 26 and is made up of resistors 31–51, an indicator light 55, capacitors 56–63, a zener diode 65, diodes 66–69, transistors 71–78, an operational amplifier 80, a three position control switch 81, and an inductive ignition coil unit 82. The ignition coil unit 82 may be of the conventional type typically used in automobile ignition systems. The switch 81 has a movable contact 81A and three fixed contacts 81B–81D. As hereinafter explained, the apparatus 10 is switched OFF when the movable contact 81A is positioned on fixed contact 81B. Alternatively, the apparatus is switched to a normal RUN position when the movable contact 81A is positioned on the fixed contact 81C. When the movable contact 81A is positioned on the fixed contact 81D the apparatus is switched to a TEST position. The battery 26 may supply 12 volt DC.

The aforementioned ignition coil unit 82 has three terminals 90–92 and two inductive coils 93–94. The inductive coil 93 is the primary winding of ignition coil 82 and is connected between the terminals 90 and 92, while the inductive coil 94 is the secondary winding and is connected between the terminals 90 and 91. The positive terminal of the battery 26 is connected to ignition coil terminal 90 and the negative terminal of the battery 26 is connected through the emitter-collector path of the transistor 77 to ignition coil terminal 92. The high voltage and sensing lead 19 is connected to the ignition coil terminal 91.

With the switch 81 switched to its RUN position, i.e. the movable contact 81A switched on the fixed contact 81C, and assuming that the pilot burner 12 is lit, the apparatus 10 operates in the following manner. The pilot burner flame formed by the burning gas 11 surrounding the tip of the metal electrode 17 is ionized and electrically connects the electrode 17 with the pilot burner 12. As a consequence, a sensing current flows from the positive terminal of the battery 26 through the inductive coil 94, terminal 91, sensing lead 19, metal electrode or probe 17, ionized gas 11, burner 12, resistor 31 and back to the negative terminal of the battery 26 through the parallel current paths defined by the diode 66- resistor 32 and the base-emitter current path of the transistor 71, the current flow through the base-emitter path of the transistor 71 occurring since the voltage generated across the resistor 32 exceeds the base-emitter threshold voltage of the transistor 71.

As a consequence of the relatively large value of the resistor 35, the low current injection through the base-emitter path of the transistor 71 causes the collector-emitter path of the transistor 71 to be rapidly biased into conduction and saturation, virtually independent of the gain of the transistor 71. With the transistor 71 so biased into saturation, all other transistors in the circuitry 25 are biased off and the total current draw of the apparatus 10 in the standby or sensing mode is the saturation current flowing through the resistor 35 and collector-emitter path of the transistor 71. The magnitude of this saturation current was less than 2 microamperes in an ignition apparatus 10 constructed in accordance with the present invention which is less than one-tenth the typical standby current draw of prior art ignitors.

If the pilot burner 12 flames out during the above-described standby mode of operation due to wind, gas surge or any other cause, the path of current conduction through the gas 11 surrounding the probe 17 is consequently open-circuited. As a result, the current flow through the biasing resistor 32 and base-emitter path of the transistor 71 stops and the collector-emitter current path of the transistor 71 is biased into a nonconductive state. In this regard, it is noted that charge which had accumulated on the capacitor 57, and which had functioned to maintain a substantially constant bias voltage on the base of the transistor 71, is discharged through the current path defined by the diode 66 and resistor 32.

With the emitter-collector current path of the transistor 71 biased in a nonconductive state, the current flowing through resistor 35 is injected through the base-emitter path of the transistor 72 to bias the collector-emitter current path of the transistor 72 into conduction. As a consequence, a voltage is generated at the junction of resistors 36, 37 which biases the emitter-collector current path of transistor 73 on, which in turn causes a voltage to be generated at the junction of resistors 38, 39 to bias the collector-emitter current path of the transistor 74 into conduction. The conduction of the collector-emitter current path of the transistor 74 causes a voltage signal to be generated between resistors 40, 41 which switches the transistor 75 on, that is to say, the emitter-collector current path of the transistor 75 is biased into a conductive state.

With current flowing through the emitter-collector current path of the transistor 75, a voltage is generated on circuit point 98 to bias the transistor switch 78 on and circuit point 99 to drive the operational amplifier 80. The operational amplifier 80 along with the resistors 43–46 and zener diode 65 form an astable multivibrator which cycles at the relatively high rate of 100 pps. In response to the voltage signal generated on terminal 99 which is applied to the positive input of the operational amplifier 80, the multivibrator is switched from a disabled to an enabled state and positive voltage pulses are generated thereby and are transmitted through resistor 47 to the base of the transistor 76. Each positive voltage pulse biases the collector-emitter current path of the transistor 76 into conduction which, in turn, generates a voltage signal across resistor 49 that turns on the transistor switch 77 to cause a normal $\int Vdt/L$ current rise in the ignition primary coil 93. Thus, current in the coil 93 is increased at a selected rate.

The current rise in the coil 93 is programmed for efficiency to increase only to a predetermined optimum current level such as, for example, three amperes. This is accomplished by controlling or programming the time duration of the positive pulses generated and outputted by the operational amplifier 80. The trailing or negative-going edge of the pulses outputted by the amplifier 80 are coupled through the series-connected resistor 48-capacitor 61 and operate to turn off the transistor 76.

The turning off of the transistor 76, in turn, causes the collector-emitter current path of the transistor 77 to be biased off. As a consequence, the voltage on the collector of the transistor 77 rises rapidly and the field of the coil 93 collapses across the current path defined by the metal probe 17, high voltage lead or cable 19, coil 94, capacitor 62, parallel-connected capacitor 56 and indicator light 55, and pilot burner 12 to deliver an ignition spark across the spark gap defined between the metal probe 17 and pilot burner 12, thus reigniting gas 11.

It should be noted that upon generation of the ignition spark, a negative current flow is generated through the capacitor 56 and lamp 55, whereupon, the load provided by the lamp 55 and capacitor 56 functions to limit the maximum voltage across the gap between the burner 12 and probe 17, such as to a 100 volt maximum with respect to battery negative. Such negative current flow is further transmitted through resistor 32 to keep the transistor 71 biased off as long as the flame of the pilot burner 12 remains extinguished. Also, note that the resistor 31 and capacitor 57 function to absorb any RF surges generated during, or in connection with, the delivery of an ignition pulse.

In the manner above described, high energy ignition sparks will be delivered to reignite the pilot burner 12 immediately upon flame-out until the latter is reignited through the single probe or electrode 17, which is used both for sensing and for ignition spark delivery. Upon reignition of the pilot burner 12, the transistor 71 will be immediately turned on to switch the apparatus 10 from its ignition spark generating mode back to its standby mode of operation.

During operation of the apparatus 10, the zener diode 65 functions to increase the width of the positive output pulses of the operational amplifier 80 as the effective output voltage of the battery 26 decreases, for example, due to discharge, age or temperature. Accordingly, the apparatus 10 can operate to deliver ignition sparks of sufficient energy even when the battery 26 has discharged to as low as one-half its normal voltage level. The apparatus 10 is, therefore, operable to self-compensate against variations in output level of the battery 26. Further, it is noted that as the ignition sparks are generated, the flashing of the indicator lamp 55 will give a reliable and positive indication of such sparking.

The capacitor 63 in the circuitry 25 is a filter capacitor which is connected across the terminals of the battery 26 through transistor switch 78 and diode 69 to enhance battery life. The diode 69 is connected with its polarity, in a sense, opposite to that of the battery 26 so that with the transistor switch 78 off as it is in the apparatus standby mode, no current flows to the capacitor 63. Accordingly, there is no current leakage and power loss occurring during the standby mode of operation of the apparatus 10.

Upon burner flame-out, the apparatus 10 switches to its pulse generating mode of operation and the collector-emitter path of the transistor 78 is biased into conduction to connect the capacitor 63 across the battery 26. During the building up and collapsing of the electrical fields in the ignition coil unit 82 associated with generation of ignition sparks, the capacitor 63 functions to filter the voltage appearing across the battery terminal 26, thus protecting the battery 26 and enhancing battery life. The transistor 78 functions to allow current to be supplied to the capacitor 63 to recharge it during the coil current off interval. Such a recharge current may, for example, be a 100 milliampere current for approximately 30 milliseconds. The diode 69 operates to deliver current to the coil 93 during the coil recharge current surge.

When the control switch 81 is switched from RUN to TEST, i.e. the movable contact 81A is switched to fixed contact 81D, ion current flowing through resistor 32 is diverted to flow through the lower resistance path defined by resistors 33, 34 and capacitor 58. As a consequence, the transistor 71 is biased off and ignition sparks are generated in the manner previously described. The visual indication provided by the short flashing of indicator light 55 verifies complete end-to-end system status including battery condition; correct probe-burner gap; and circuit continuity and operability. Further, in the test mode, proper flame and fuel mixture is indicated by the fact that sufficient ion current flow will charge the capacitor 56 so as to bias the transistor 71 back into conduction to rapidly cease the generation of the ignition sparks. Thus, if the apparatus 10 is operating properly, the indicator lamp 55 will be flashed for only a short period of time in the test mode.

Switching the control switch 81 to the OFF position, i.e. the movable contact 81A is switched to the fixed contact 81B, has the effect of grounding the output of the transistor 71, thus shutting the apparatus 10 down. It is noted that if the control switch 81 is switched from OFF to RUN, the apparatus 10 will either go into ignition spark generating mode or standby mode, depending on whether or not the pilot burner 12 is lighted.

In the apparatus 10 herein described an "optimized" inductive discharge type circuit is utilized wherein little energy is wasted either in the storage or discharge modes. This is accomplished by generating the ignition spark as soon as the energy in the coil 93 has a sufficient level. By breaking the coil charging circuit the instant the charging current in the coil 93 has reached a sufficient level, such as 3 amperes, the need for use of a ballast resistor to limit charging current is eliminated. As a consequence, the energy losses associated with such prior art ballast resistors are also eliminated.

Although the invention has been herein shown and described in what is conceived to be the most practical and preferred embodiment, it is recognized that departures may be made from the preferred embodiment within the scope of the invention.

What is claimed is:

1. Apparatus for igniting and reigniting combustible fuel emitted from pilot burner structure or the like, comprising:

electrically-conductive means through which said fuel is emitted from said pilot burner structure;

electrically-conductive probe means for positioning adjacent said pilot burner structure in the region in which said fuel is emitted;

ignition coil means for generating ignition sparks, said coil means having a primary and secondary coil and three terminals, said secondary coil being connected between said first and second coil terminals, said primary coil being connected between said first and third coil terminals;

first means for connecting said probe means electrically with said second coil terminal;

power supply means for supplying a DC voltage, said power supply means having first and second voltage output terminals across which said DC supply voltage is generated;

second means for connecting said first voltage output terminal electrically with said first coil terminal;

third means for connecting said second voltage terminal electrically with said electrically-conductive means through which said fuel is emitted;

means for sensing the combustion of said emitted fuel, said sensing means being operable to generate a first signal when said emitted fuel is burning and a second signal when said emitted fuel is not burning; and, switch means for electrically interconnecting said third coil terminal with said second voltage output terminal, said switch means having a closed circuit state in which said third coil terminal is connected with said second voltage output terminal and an open circuit state in which said third coil and voltage output terminals are disconnected from each other, said switch means being triggered by said first signal generated by said sensing means into said open circuit state whereby a substantially constant ion current flows through said primary coil and said burning emitted fuel, said switch means being responsive to said second signal generated by said sensing means to cycle at a predetermined rate between said closed and open circuit states whereby the electrical field in said primary coil periodically increases and collapses to generate ignition sparks between said probe means and electrically-conductive means through which said fuel is emitted thereby to ignite said emitted fuel.

2. The invention defined in claim 1, wherein said sensing means is operable to monitor ion current flow through said emitted gas and between said probe means and electrically-conductive means through which said fuel is emitted, said sensing means being operable in response to said ion current flow in a predetermined sense to generate said first signal, said predetermined sense of ion current flow corresponding to the ion current flow through said burning emitted fuel caused by said DC supply voltage, said sensing means being otherwise operable to generate said second signal indicative of pilot burner flame-out.

3. The invention defined in claim 1, wherein:

said sensing means includes first transistor means responsive to said ion current flow for generating said first and second signals; and, said switch means includes second transistor means driven by multivibrator means, said second transistor means interconnecting said third coil terminal with said second voltage output terminal, said second transistor means having a conductive and nonconductive state and being driven by a pulsed output of said multivibrator means to cycle between said conductive and nonconductive state, said multivibrator means being responsive to said first signal to generate a substantially constant output and responsive to said second signal to generate a pulsed output at said predetermined rate.

4. The invention defined in claim 1, wherein:

said power supply means is a battery having first and second terminals which define, respectively, said first and second voltage output terminals; and including:

filter capacitor means connected across said battery terminals, said filter capacitor means including a filter capacitor transistor means and a diode, said transistor means being responsive to said first and second signals to define, respectively, a nonconductive and conductive current path, said diode being connected in parallel with said transistor current path in a sense of polarity opposed to the polarity of said battery, said parallel connected transistor means and diode being connected in series with said filter capacitor.

5. The invention defined in claim 1, including lamp means connected in series with the current path defined between said probe means and electrically-conductive means through which said fuel is emitted whereby said lamp means is driven by the current surges making up said ignition sparks to indicate the generation of same.

6. The invention defined in claim 1, wherein said switch means in response to said second signal is cycled in said closed circuit state for a selected time period corresponding to an increase in the current in said primary coil a selected rate to a predetermined level and then switched to said closed circuit state to cause the generation of an ignition spark by an optimum conversion of energy.

7. The invention defined in claim 5, wherein said sensing means includes:

means for generating a bias voltage proportional to ion current flow through said emitted gas between said probe means and electrically-conductive means through which said fuel is emitted, said bias signal having at least a predetermined magnitude and polarity in response to said current flowing when said emitted fuel is burning; and, transistor means responsive to said bias voltage to generate said first signal whenever said bias signal is of said predetermined polarity and exceeds said predetermined magnitude, said transistor means otherwise being operable to generate said second signal; and including:

means for selectively shunting in part said ion current flowing through said bias voltage generating means whereby said bias voltage falls below said predetermined magnitude and said second signal is generated to cause test ignition sparks to be generated; and, capacitor means connected in parallel with said bias voltage generating means to augment said bias voltage and increase same above said predetermined level if said current flow is sufficient to indicate proper burning of said emitted fuel.

8. The invention defined in claim 5, wherein said sensing means includes:

means for generating a bias voltage proportional to ion current flow through said emitted gas between said probe means and electrically-conductive means through which said fuel is emitted, said bias signal having at least a predetermined magnitude and polarity in response to said current flowing when said emitted fuel is burning; and, transistor means responsive to said bias voltage to generate said first signal whenever said bias signal is of said predetermined polarity and exceeds said predetermined magnitude, said transistor means otherwise being operable to generate said second signal; and including:

means for selectively shunting in part said ion current flowing through said bias voltage generating means whereby said bias voltage falls below said predetermined magnitude and said second signal is generated to cause test ignition sparks to be generated; and, capacitor means connected in parallel with said bias voltage generating means to smooth said bias voltage and hold same above said predetermined level if said current flow is sufficient to indicate proper burning of said emitted fuel.

9. The invention defined in claim 6, wherein:

said power supply means is a battery; and including:

means responsive to the voltage level of said battery for increasing the selected time period said switch means is cycled in said closed circuit state as said battery voltage level decreases whereby to compensate for charging time increase caused by low battery voltage level.

10. The invention defined in claim 7, including means for selectively disabling said transistor means to turn said ignition apparatus off.

11. The invention defined in claim 7 including further capacitor means connected in parallel with said bias voltage generating means to smooth said bias voltage and hold same above said predetermined level if said current flow is sufficient to indicate proper burning of said emitted fuel.

12. The invention defined in claim 9, wherein said switch means includes:

multivibrator means for cycling said switch means between said closed circuit and open circuit states; and, said means for increasing the selected time period said switch means is cycled in said closed circuit state is zener diode means connected to control the input voltage of said multivibrator means.

13. Apparatus for igniting and reigniting combustible fuel emitted from pilot burner structure or the like, comprising:

electrically-conductive means for defining a spark gap in the region of said emitted fuel;

means responsive to ion current flow across said spark gap for sensing the combustion of said emitted fuel, said sensing means being operable to generate a first signal to indicate that said emitted fuel is burning and a second signal to indicate that said emitted fuel is not burning;

means for generating ignition sparks across said spark gap, said ignition spark generated means having a disabled state in which none of said ignition sparks is generated and an enabled state in which said ignition sparks are periodically generated at a predetermined rate, said ignition spark generating means being triggered by said first signal into said disabled state and triggered by said second signal into said enabled state, said ignition spark generating means including an ignition coil having primary and secondary winding cooperating in said enabled state to generate ignition pulses by increasing the current in said primary coil and then stopping the supply of said current to cause the collapse of the electrical field generated in said primary coil, and means for limiting the current rise in said ignition coil to a predetermined magnitude including a pulse generator operative to deliver pulses to the primary winding of said coil at a predetermined rate when in the enabled state and cut-off means connected to said pulse-generating means effective to limit the time interval during which said pulses are delivered.

14. The invention defined in claim 13, wherein said ignition apparatus is powered by a battery having a pair of voltage output terminals, and including filter capacitor means selectively connected across said battery terminals to protect said battery and enhance its life, said filter capacitor means being responsive to said first and second signals to be selectively connected across said battery terminals only when said second signal is being generated.

15. The invention defined in claim 14 wherein compensating means responsive to a decrease in the output voltage of the battery is connected to the pulse generating means, said compensating means being operative to maintain the output of said pulse-generating means at an energy level effective to produce the ignition sparks.

16. In an apparatus for igniting and reigniting combustible fuel emitted from pilot burner structure or the like having electrically-conductive means for defining a spark gap in the region of said emitted fuel, means for generating a DC voltage across said spark gap whereby if said emitted fuel is burning an ion current flows thereacross, and means for sensing ion current flow across said spark gap and generating ignition sparks across said spark gap when there is substantially no ion current flow thereacross, the improvement which comprises:

pulse generating means connected to deliver pulses to said spark generating means at a predetermined rate when no ion current flows across said spark gap, and cut-off means connected to said pulse generating means operative to limit the time during which said pulses are delivered to a predetermined interval.

17. In a method of igniting and reigniting combustible fuel emitted from pilot burner structure or the like which includes the steps of sensing ion current flow through the emitted fuel to determine if same is ignited and generating ignition sparks through the emitted fuel to ignite same whenever the ion current flow therethrough indicates that the fuel is not burning, the improvement which comprises:

generating the ignition sparks by increasing the current flow in an inductive coil at a predetermined rate and terminating said current flow after a predetermined time interval so as to collapse the electrical field and limit said current level to a selected maximum value.

* * * * *